US005080118A

United States Patent [19]

Allen

[11] Patent Number: 5,080,118

[45] Date of Patent: * Jan. 14, 1992

[54] UMBRELLA HANDLE

[75] Inventor: James H. Allen, Covington, Ky.

[73] Assignee: 'totes', incorporated, Loveland, Ohio

[ * ] Notice: The portion of the term of this patent subsequent to Jun. 5, 2007 has been disclaimed.

[21] Appl. No.: 494,230

[22] Filed: Mar. 15, 1990

Related U.S. Application Data

[63] Continuation of Ser. No. 258,818, Oct. 17, 1988.

[51] Int. Cl.[5] ..... A45B 25/00

[52] U.S. Cl. ..... 135/25.4; 294/137

[58] Field of Search ..... 135/37, 44, 36 R, 36 F; 242/107.1, 107.13; 294/137, 167; 24/115 G, 115 L, 136 L

[56] References Cited

U.S. PATENT DOCUMENTS

| | | | |
|---|---|---|---|
| D. 284,234 | 6/1986 | Allen . | |
| D. 284,713 | 7/1986 | Brinker . | |
| D. 287,543 | 1/1987 | Cain . | |
| D. 290,547 | 6/1987 | Cain . | |
| D. 291,385 | 8/1987 | Selig . | |
| D. 291,502 | 8/1987 | Cain . | |
| D. 292,042 | 9/1987 | Selig . | |
| D. 295,693 | 5/1988 | Cain . | |
| D. 296,265 | 6/1988 | Allen . | |
| 539,654 | 5/1895 | Stewart | 242/107.13 X |
| 703,709 | 7/1902 | Olmstead | 242/107.1 |
| 800,049 | 9/1905 | Ayres | 242/107.1 |
| 2,678,779 | 5/1954 | Bellmer | 242/107.1 |
| 3,061,234 | 10/1962 | Morey | 242/107.1 |
| 3,323,829 | 6/1967 | Liem | 242/107.1 |
| 3,892,251 | 7/1975 | Warfield | 135/20 R |
| 4,165,053 | 8/1979 | Konig | 242/107.1 |
| 4,603,481 | 8/1986 | Cohen et al. | 242/107.2 |
| 4,616,868 | 10/1986 | Okuda . | |
| 4,624,276 | 11/1986 | Allen . | |

FOREIGN PATENT DOCUMENTS 654806 6/1951 United Kingdom .

*Primary Examiner*—David A. Scherbel
*Assistant Examiner*—Lan Mai
*Attorney, Agent, or Firm*—Wood, Herron & Evans

[57] ABSTRACT

An umbrella with a carrying strap retractable interiorly of the umbrella's handle to a storage position when use of the strap is not desired, and extendable exteriorly of the handle into a use position when it is desired to carry the umbrella with aid of the strap.

20 Claims, 2 Drawing Sheets

UMBRELLA HANDLE

This is a continuation of application Ser. No. 07/258,818, filed Oct. 17, 1988.

This invention relates to umbrellas. More particularly, this invention relates to an umbrella with a unique carrying strap.

Umbrellas have been known for many years. It is also very well known to attach a carrying strap to an umbrella's handle. This carrying strap often is attached only at once end to the handle, and is free swinging. The purpose of the strap, which commonly is in the form of a loop, is to allow the umbrella's owner to more easily carry the umbrella. When the umbrella is opened in the normal use position, or when the umbrella is folded or closed into the normal storage position, and if the carrying strap is in the form of a loop, the umbrella owner's hand may be slipped through the loop. Thereafter the owner's hand grasps the umbrella's handle in order to carry the umbrella. The purpose of the carrying loop, in that use mode, is to prevent the umbrella from falling away if the handle slips out of the user's hand. Such carrying straps are most often used on collapsible umbrellas, but might also be used on stick umbrellas.

A collapsible umbrella is often stored by the umbrella's owner in a location where it is jumbled with other items. Typical storage locations of a collapsible umbrella might be a briefcase, a lady's handbag, a tote bag, an automobile glove compartment, or the like. When the umbrella is withdrawn from its storage location, and if the umbrella has been more or less jumbled within that storage location relative to other items that might be stored therein, the free swinging strap on occasion tends to disrupt storage of those other items as the umbrella is withdrawn from its storage position. In other words, the umbrella's carrying strap may catch on to whatever other items might be kept in the storage location, and thereby disrupt the storage of those other items when the umbrella's owner only desires to withdraw the umbrella from the storage location. Further, and when the umbrella is folded or collapsed, the carrying strap tends to swing free or dangle from the umbrella's handle. If the collapsible umbrella is being carried with the carrying strap swinging free, it is possible that the strap, particularly when it is in the form of a loop, might become caught on whatever object the owner is passing at the time.

It has been an objective of this invention to provide an umbrella with a carrying strap that is retractable interiorly of the umbrella's handle into a storage position when use of the strap is not desired, and extendable exteriorly of the handle into a use position when it is desired to carry the umbrella with said of the strap.

It has been another objective of this invention to provide an umbrella with carrying strap that is extendable from and retractable into storage position within the umbrella's handle where the strap is connected to a retraction mechanism that causes the strap to be retracted interiorly of the handle when the storage of the strap is desired.

It has been a further objective of this invention to provide an umbrella with carrying strap that is extendable from and retractable into storage position within the umbrella's handle, a retraction mechanism being connected to the strap that functions to exert a retract force continuously on the strap even when the strap is in a use position exteriorly of the handle, the strap thereby automatically retracting into its storage position within the umbrella's handle when it is released by the umbrella user from its use position.

Other objectives and advantages of this invention will be more apparent from the following detailed description taken in conjunction with the drawings in which.

Figure 1:
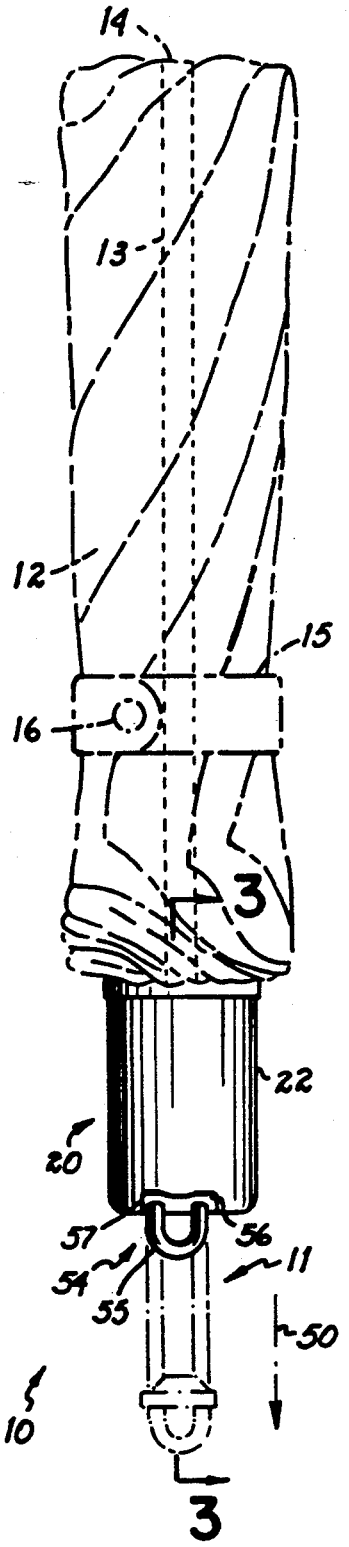
FIG. 1 is an elevational view of a collapsible umbrella with retractable carrying strap in accord with the principles of this invention.

An umbrella 10 with retractable carrying strap 11 in accord with the principles of this invention is illustrated in FIG. 1. The umbrella 10 includes a cover 12 adapted to be opened and closed between umbrella use (not shown) and storage (see FIG. 1) positions by a rib linkage system (not shown). The cover 12 is connected to a centerpost 13 at one end 14 of that centerpost. The rib linkage system (not shown) is fixed to the centerpost 13 and to the cover 12 for raising and lowering the cover, i.e., for opening and closing the umbrella, between use and storage positions. A closure strap 15 is fixed to the cover at one end, the closure strap being of a length sufficient to permit same to encircle the collapsed and folded cover 12 so as to hold the cover and the rib linkage system (not shown) in the closed position shown in FIG. 1. A first snap part 16 is provided on the free end of the closure strap to cooperate with a second snap part (not shown) on the end of the strap fixed to the cover 12 so that the closure strap 15 can be held in the closure position shown in FIG. 1. The other end of the centerpost 13 is connected to a handle 20 with the retractable carrying strap 11.

Figure 2:
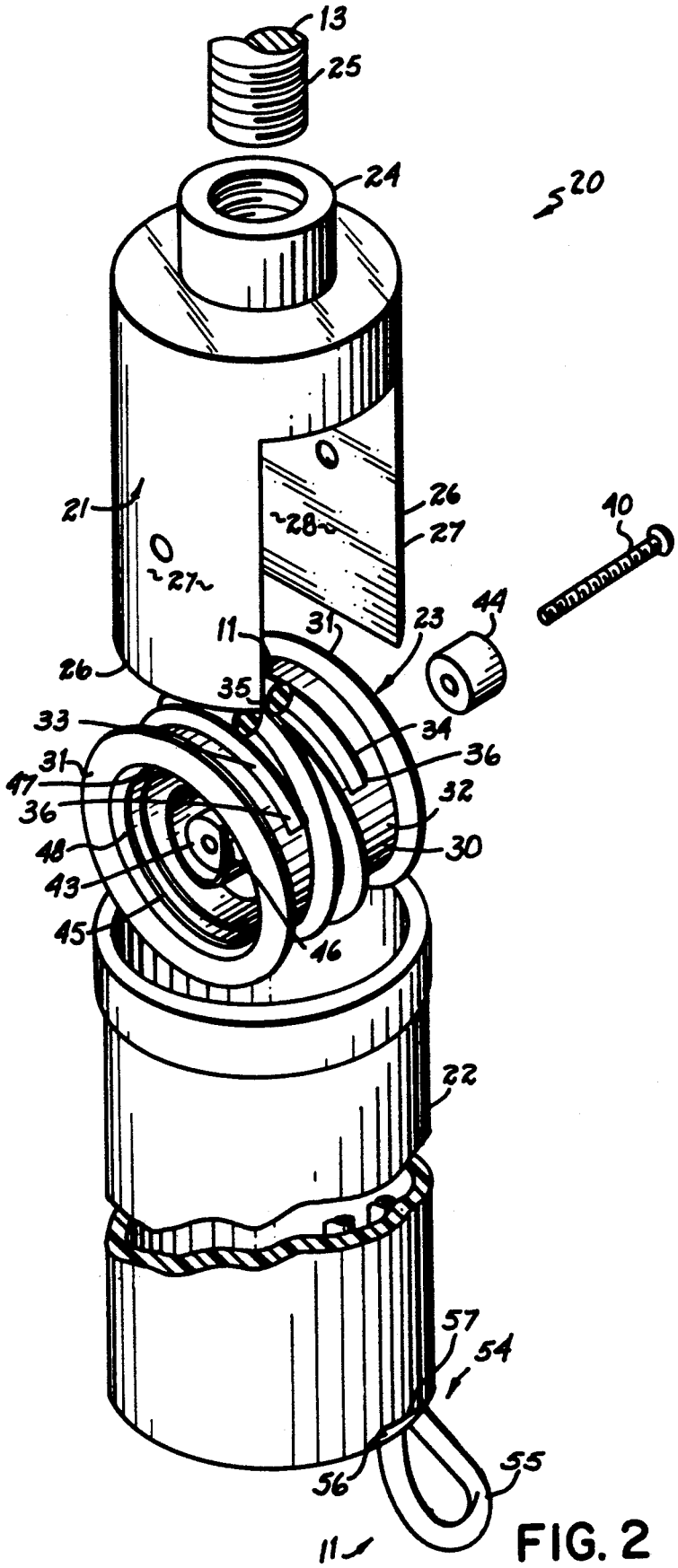
FIG. 2 is an exploded perspective view of an umbrella handle in accord with the principles of this invention, the drum being slightly enlarged for clarity.

The handle 20, as shown in FIG. 2, basically includes a yoke or handle plug 21, a (which is in the form of a casing having a handle chamber interiorly thereof) carrying strap 11, and a wind up drum 23. The yoke or handle plug 21 is provided with connector structure in the form of an internally threaded flange 24 at one end, same permitting the yoke to be fixedly connected to connector structure in the form of exteriorly threaded end 25 of the centerpost 13. Note particularly the yoke includes opposed arms 26 which are curvedly configured on their outer surface 27 to mate with the circular inside cross section of the handle shell 22. Note also the yoke's arms 26 are provided with planar parallel inside surfaces 28 within which the windup drum 23 is mounted. After the windup drum 23 and carrying strap 11 are assembled with the handle shell 22 and yoke 21, the shell and yoke are telescoped one within the other where they are glued or otherwise held in assembled relation as particularly shown in FIG. 4.

Figure 5:
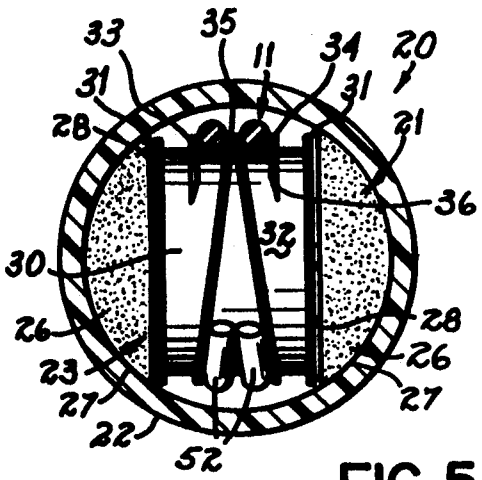
FIG. 5 is a cross-sectional view taken along line 5—5 of FIG. 4.
Figure 3:
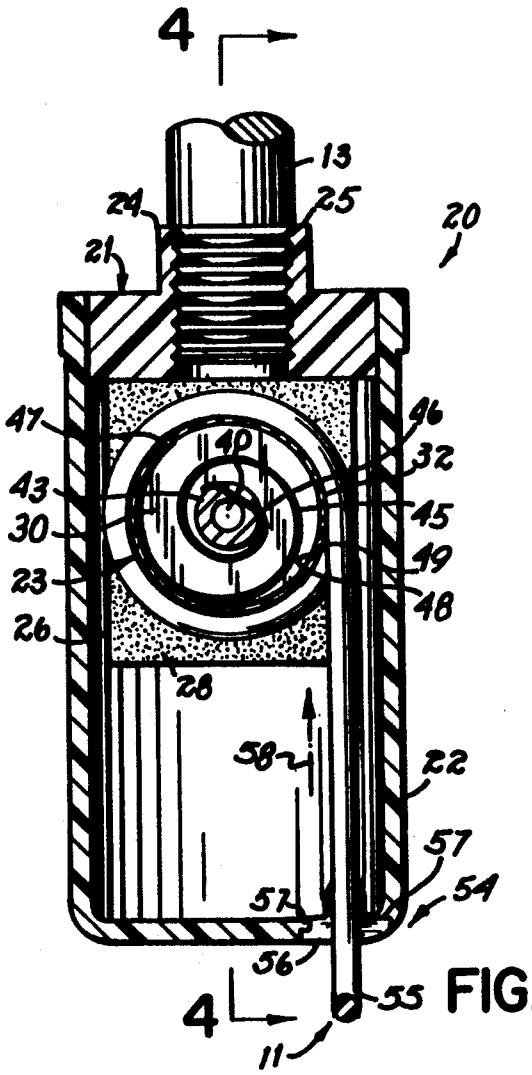
FIG. 3 is a cross-sectional view taken along line 3—3 of FIG. 1.
Figure 4:
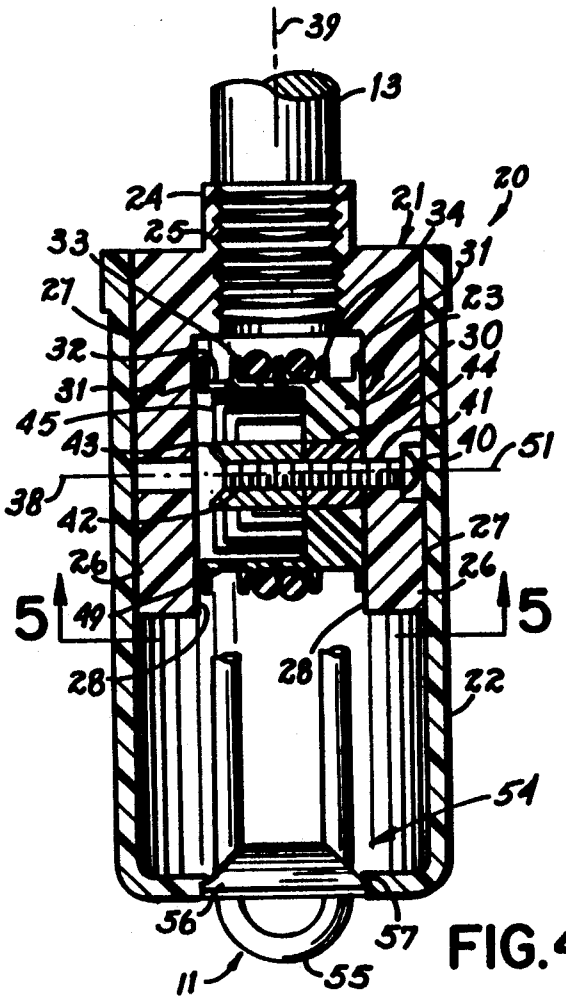
FIG. 4 is a cross-sectional view taken along line 4—4 of FIG. 3.

The windup drum 23 includes a cup-shaped hub 30 having opposed side flanges 31 and an exterior surface 32 on which the carrying strap 11 is wound up, see FIGS. 2, 4 and 5. Note particularly the outer surface 32 of the cup-shaped hub is provided with a pair of spirally wound guide tracks 33, 34, each guide track being spirally wound from one end 35 centrally disposed on the hub surface between the flanges to another end 36 spaced between the hub's center plane and the respective flange 31 which it serves. In this regard, and as shown in FIG. 5, the guide tracks 33, 34 on the hub surface form a generally V-shaped configuration relative one to the other as same traverse the circumference of the cup-shaped hub. The wind-up drum 30 is rotatable on an axis 38 oriented normal to centerpost axis 39. The rotation axis 38 is defined by axle bolt 40 which is fixed at one end 41 to the yoke 21 as shown in FIG. 3, and fixed at other end 42 to nut 43. The cup-shaped hub 30 is provided with a bearing 44, also as shown in FIG. 4, interposed between the nut 43 and the yoke 21, the cup-shaped hub 30 thereby being rotatable on that bearing 44 relative to the yoke and the nut 43.

A spring motor 45 is connected to the strap 11 interiorly of the cup-shaped hub 30, that motor functioning to exert a retract force continuously on the strap even when the strap is in its manual use position. Accordingly, the strap automatically retracts into its storage position shown in FIG. 3 when it is released by the umbrella user from its use position shown in phantom lines in FIG. 1. This spring motor 45 is in the form of a coil spring connected between the handle 20 and the strap 11, that end 46 of the spring connected to the handle being fixed to nut 43 as shown in FIG. 3, and that end 47 of the spring connected to the strap being fixed to the interior face 48 of the cup-shaped hub's side wall 49 as shown in FIG. 4. The coil spring 45 is oriented and loaded so that it continuously provides a biasing force in the counterclockwise direction as shown in FIG. 3, i.e., so that the strap 11 is continuously biased toward its storage position illustrated in FIGS. 1 and 3. The coil spring's center axis 51, therefor, is coaxially aligned with the rotational axis 38 of the cup-shaped hub 30.

The carrying strap 11 itself is in the form of a closed loop. One end 52 of the closed loop is fixed to the cup-shaped hub's outer surface 32 as shown in FIG. 5. That the carrying strap 11 is in the form of a closed loop is illustrated in FIG. 1 (in the phantom line extended use position therein illustrated) and in FIG. 4. The free end 54 of the carrying strap 11 is provided with a finger grip 55 attached to that strap, the finger grip being manually accessible to the umbrella user even when the strap is in the storage position illustrated in FIG. 4 so that the strap can be manually pulled against the spring 45 bias from that storage position to the use position illustrated in phantom lines in FIG. 1 by the umbrella user. The outer end 54 of the carrying strap 11 also includes a stop 56 connected to that strap. The stop 56 which is in the form of a plug fixed to the strap, cooperates with the handle 20 to locate finger grip 55 in its manually accessible position when the strap 11 is in its storage position. More specifically, plug 56 cooperates with a seat 57 defined in the handle shell 22, the plug being received in the seat, as clearly shown in FIGS. 1, 3 and 4, so as to locate the strap in the storage position.

In use, and as shown in FIGS. 1, 2, 3 and 4, the carrying strap 11 is normally in the storage position when use of the strap is not desired. This storage position of the carrying strap 11 is achieved because of the continuous spring bias exerted by coil spring 45. This coil spring 45 bias continuously exerts a retract force, shown by phantom arrow 58, (shown in FIG. 3) on the strap 11 even when the strap is extended into its use position so that when it is released from the use position by the umbrella user it automatically retracts into the storage position shown.

When the umbrella's owner desires to make use of the closed loop carrying strap 11, i.e., when the umbrella's owner wishes to withdraw the strap from the handle and insert his or her wrist through the loop so as to said in carrying the umbrella, the umbrella's owner first grasps the lead 55 attached to the strap and withdraws the strap against the coil spring 45 bias in the direction shown by phantom arrow 50 so as to extend it exteriorly of the handle into the use position shown in phantom lines in FIG. 1. In this use position, and while holding the closed loop carrying strap 11 outwardly against the coil spring 45 bias, the umbrella's owner simply slips his or her wrist through that loop and thereafter grasps the umbrella's handle 20 with that hand extended through the loop.

When it is desired to retract the carrying loop 11 once again interiorly of the handle 20, the umbrella's owner simply withdraws his hand through the loop and the coil spring 45 then biases or retracts the loop interiorly of the handle until it is positioned in its storage position where the carrying strap stop 56 is located in the handle's seat 57 as before discussed.

Having described in detail the preferred embodiment of my invention, what I desire to claim and protect by Letters Patent is:

1. A handle for an umbrella, the umbrella including a cover adapted to be opened and closed between use and storage positions, respectively, and a center post having first and second ends, the cover being connected to the first end o the center post, said umbrella handle comprising:

an outer shell defining a hollow interior and having a top end, said outer shell being sized and configured for gripping by a user's hand and further having an opening therein, the top end of said outer shell being adapted for connecting to the second end of the center post;

a carrying strap being sized and configured for gripping by a user's hand;

retraction means located within the hollow interior of said outer shell and being connected to one end of said carrying strap for moving said carrying strap from an extended position to a retracted position, said carrying strap being stored within the hollow interior of said outer shell when in the retracted position and being located exteriorly of said outer shell when in the extended position, said carrying strap being retractable into and extendable from the hollow interior through the opening in said outer shell to either the retracted position for storing said carrying strap or the extended position for carrying said handle via said carrying strap, respectively, irrespective of whether said handle is connected or disconnected to the center post and irrespective of whether the cover of the umbrella is in an opened or closed position when said handle is connected to the center post; and connector means for connecting said handle to the center post of the umbrella.

2. A handle as set forth in claim 1, said handle further comprising:

a finger grip attached to said strap, said finger grip being manually accessible to an umbrella user when said strap is in said storage position so said strap can be manually moved from said storage position to said use position by the umbrella user.

3. A handle as set forth in claim 1, said handle further comprising;

a finger grip attached to said strap, said finger grip being manually accessible to an umbrella user when said strap is in said storage position so said strap can be manually moved from said storage position to said use position by the umbrella user;

a spring biased roller motor connected to said strap, said spring biased roller motor functioning to exert a retract force continuously on said strap even when said strap is in said use position, said strap automatically retracting into said storage position when it is released by the umbrella user from said use position; and a stop connected to said strap, said stop cooperating with said outer shell to locate said finger grip in its manually accessible position when said strap is in said storage position.

4. A handle as set forth in claim 3, said stop comprising:

a plug fixed to said strap; and a seat defined in the outer end of said outer shell, said plug being receivable in said seat when said strap is in said storage position.

5. A handle as set forth in claim 1, said retraction means comprising:

a spring biased roller connected to said strap, said spring biased roller functioning to exert a retract force continuously on said strap even when said strap is in said sue position, said strap automatically retracting into said storage position when it is released by the umbrella user from said use position.

6. A handle as set forth in claim 5, said strap being restrained manually in said use position.

7. A handle as st forth n claim 5, said spring biased roller comprising:

a spring having first and second ends; and a wind-up drum, the first end of said spring being connected to said wind-up drum and the second end of said spring being connected to said strap.

8. A handle as set forth in claim 7, said wind-up drum being rotatably mounted within the hollow interior of said outer shell, said strap being at least partially wound on said drum in said storage position.

9. A handle as set forth in claim 8, said strap being in the form of a loop, and said wind-up drum comprising:

at least one spiral track to guide said strap into and off it wind-up position on said drum so that said strap lays flat on said drum when in said storage position.

10. A handle as st forth in claim 8, said handle further comprising:

a yoke on which said drum is rotatably mounted, said yoke being flexible to the center post; and said outer shell being mounted on said yoke, said outer shell presenting an exterior surface which can be gripped by the umbrella user, and said strap being retractable into and extendable from said outer shell.

11. A handle for an umbrella, the umbrella including a cover adapted to be opened and closed between use and storage positions, respectively, and a center post having first and second ends, the cover being connected to the fist end of the center post, said umbrella handle comprising:

an outer shell defining a hollow interior and having a top end, said outer shell being sized and configured for gripping by a user's hand and further having an opening therein, the top end of said outer shell being adapted or connecting to the second end o the center post;

a carrying strap being sized and configured for gripping by a user's hand;

retraction means located within the hollow interior of said outer shell and being connected to one end of said carrying strap for moving said carrying strap from an extended position to a retracted position, said carrying strap being stored within the hollow interior of said outer shell when in the retracted position and being located exteriorly of said outer shell when in the extended position, said carrying strap being retractable into and extendable from the hollow interior through the opening in said outer shell together the retracted position for storing said carrying strap or the extended position or carrying said handle via said carrying strap, respectively, irrespective of whether said handle is connected or disconnected to the center post nd irrespective of whether the cover of the umbrella is in an opened or closed position when said handle is connected to the center post;

storing means located within the hollow interior of said outer shell and being operatively associated with said retraction means for storing said carrying strap upon retraction thereof within the hollow interior of said outer shell of said handle; and connector means for connecting said handle to the center post of the umbrella.

12. A handle as set forth in claim 11, said handle further comprising:

a finger grip attached to said strap, said finger drip being manually accessible to the umbrella user when said strap is in said storage position so said strap can be manually moved from said storage position to said use position by the umbrella user;

a spring biased roller connected to said strap, said spring biased roller functioning to exert a retract force continuously on said strap even when said strap is in said use position, said strap automatically retracting into said storage position when it is released by the umbrella user from said use position; and a stop connected to said strap, said stop cooperating with said outer shell to locate said finer grip in its manually accessible position when said strap is in said storage position.

13. A handle as set forth in claim 12, said stop comprising:

a plug fixed to said strap; and a seat defined in the outer end of said outer shell; said lug being received in said seat when said strap is in said storage position.

14. A handle as set forth in claim 11, said handle further comprising:

a finger grip attached to said strap, said finger grip being manually accessible to the umbrella user when said strap is in said storage position so said strap can e manually moved from said storage position to said use position by the umbrella user.

15. A handle as set forth in claim 11, said retraction means comprising:

a spring biased roller connected to said strap, said spring biased roller functioning to exert a retract force continuously on said strap even when said strap is in said use position, said strap automatically retracting into said storage position when it is released by the umbrella from said use position.

16. A handle as set forth in claim 15, said strap being restrained manually in said use position.

17. A handle as set forth in claim 15, said spring biased roller comprising:

a spring having first and second ends; and a wind-up drum, the first end of said spring being connected to said wind-up drum and the second end of said spring being connected to said strap.

18. A handle as set forth in claim 17, said wind-up drum being rotatably mounted within the hollow interior of said outer shell, said strap being at least partially wound on said drum in said storage position.

19. A handle as set forth in claim 18, said strap being in the form of a loop and said wind-up drum comprising:

at least one spiral rack to guide said strap into and off of its wind-u- position on said drum so that said strap lays flat on said drum when in said storage position.

20. A handle as set forth in claim 19, said handle further comprising:

a yoke on which said drum is rotatably mounted, said yoke being fixable to said center post; and said outer shell mounted on said yoke, said outer shell presenting an exterior surface by which said outer shell is gripped by the umbrella user, said strap being retractable into and extendable from said outer shell.

* * * * *

UNITED STATES PATENT AND TRADEMARK OFFICE

CERTIFICATE OF CORRECTION

PATENT NO. : 5,080,118

DATED : January 14, 1992

INVENTOR(S) : James H. Allen

It is certified that error appears in the above-indentified patent and that said Letters Patent is hereby corrected as shown below:

Col. 1, Line 54 delete "said of" and insert -- aid of --
Col. 2, Line 43 after "a" insert -- handle shell 22--
Col. 4, Line 30 delete "o" and insert -- of --
Col. 5, Line 28 delete "sue" and insert -- use --
Col. 5, Line 33 delete "n" and insert -- in --
Col. 5, Line 48 delete "st" and insert -- set --
Col. 5, Line 51 delete "flexible" and insert -- fixable --
Col. 5, Lines 61-67 delete "fist end...adapted or connecting... end o the..." and insert --first end...adapted for connecting...end of the --
Col. 6, Line 14 delete "or" and insert -- for --
Col. 6, Line delete "nd" and insert -- and --
Col. 6, Line 30 delete "drip" and insert -- grip --
Col. 6, Line 43 delete "finer" and insert -- finger --
Col. 6, Line 50 delete "lug" and insert -- plug --
Col. 6 Line 57 delete "e" and insert -- be --
Col. 8, Line 2 delete "wind-u" and insert --wind-up--

Signed and Sealed this

Fourteenth Day of December, 1993

Bruce Lehman

*Attest:*

BRUCE LEHMAN

*Attesting Officer*

*Commissioner of Patents and Trademarks*